US008971742B2

(12) United States Patent
Furuichi

(10) Patent No.: US 8,971,742 B2
(45) Date of Patent: Mar. 3, 2015

(54) IMAGE FORMING APPARATUS TO CHANGE IMAGE MAGNIFICATION BY CONTROLLING SHEET CONVEYANCE SPEED

(75) Inventor: Wataru Furuichi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 341 days.

(21) Appl. No.: 13/408,314

(22) Filed: Feb. 29, 2012

(65) Prior Publication Data

US 2012/0230716 A1 Sep. 13, 2012

(30) Foreign Application Priority Data

Mar. 11, 2011 (JP) ..... 2011-053931

(51) Int. Cl.
*G03G 15/16* (2006.01)
*G03G 15/01* (2006.01)

(52) U.S. Cl.
CPC ..... *G03G 15/167* (2013.01); *G03G 15/0189* (2013.01); *G03G 2215/00945* (2013.01); *G03G 2215/00949* (2013.01); *G03G 2215/0135* (2013.01); *G03G 2215/0196* (2013.01)
USPC ..... 399/66; 399/86; 399/156

(58) Field of Classification Search
CPC ..... G03G 15/1605; G03G 15/161; G03G 15/167; G03G 15/168
USPC ..... 399/66, 82, 85, 86, 148, 156, 297–301, 399/306
See application file for complete search history.

(56) References Cited

U.S. PATENT DOCUMENTS

| | | | | |
|---|---|---|---|---|
| 2008/0279569 | A1* | 11/2008 | Wong | 399/15 |
| 2009/0324305 | A1* | 12/2009 | Udaka et al. | 399/302 |
| 2010/0129104 | A1* | 5/2010 | Ogata et al. | 399/66 |
| 2010/0221029 | A1* | 9/2010 | Minbu et al. | 399/66 |
| 2011/0097096 | A1* | 4/2011 | Sueoka | 399/49 |

FOREIGN PATENT DOCUMENTS

| | | | |
|---|---|---|---|
| JP | 2002-2039 | A | 1/2002 |
| JP | 2009-29003 | A | 2/2009 |

* cited by examiner

*Primary Examiner* — David Gray
*Assistant Examiner* — Jessica L Eley
(74) *Attorney, Agent, or Firm* — Cantor Colburn LLP

(57) ABSTRACT

Provided is an image forming apparatus which enables control to change a longitudinal magnification of an image transferred on a sheet in a sheet conveyance direction by changing a rotation speed of a second transfer section while prohibiting misalignment of transfer without requiring a changing time of the longitudinal magnification which causes the decreasing of productivity.

6 Claims, 6 Drawing Sheets

[THICK SHEET 300gsm]

| SECONDARY TRANSFER SPEED | -5% | ±0% | +5% |
|---|---|---|---|
| LONGITUDINAL IMAGE MAGNIFICATION | -0.10% | ±0.00% | +0.20% |

[THIN SHEET 64gsm]

| SECONDARY TRANSFER SPEED | -5% | ±0% | +5% |
|---|---|---|---|
| LONGITUDINAL IMAGE MAGNIFICATION | -0.10% | ±0.00% | +0.10% |

FIG. 5a

[THICK SHEET 300gsm]

| SECONDARY TRANSFER SPEED | -5% | ±0% | +5% |
|---|---|---|---|
| LONGITUDINAL IMAGE MAGNIFICATION | -0.10% | ±0.00% | +0.20% |

FIG. 5b

[THIN SHEET 64gsm]

| SECONDARY TRANSFER SPEED | -5% | ±0% | +5% |
|---|---|---|---|
| LONGITUDINAL IMAGE MAGNIFICATION | -0.10% | ±0.00% | +0.10% |

IMAGE FORMING APPARATUS TO CHANGE IMAGE MAGNIFICATION BY CONTROLLING SHEET CONVEYANCE SPEED

This application is based on Japanese Patent Application No. 2011-053931 filed on Mar. 11, 2011, in Japanese Patent Office, the entire content of which is hereby incorporated by reference.

TECHNICAL FIELD

The present invention related to an image forming apparatus to fowl an electro latent image by exposing an image carrier, and to from an image onto a recording sheet by transferring a toner image obtained by developing the electrostatic latent image, and in particular, to control a conveyance speed of the sheet so as to change a magnification of the image.

BACKGROUND OF THE INVENTION

In the image forming apparatus to form an image by transforming the toner image onto the sheet, it is known that the sheet extends and contracts by effects of heat and pressure, and the size of the image formed on the sheet changes due to fluctuation of amounts of extension and contraction of the sheet in accordance with types of the sheets used.

There is widely used a method to change a moving speed of the image carrier as a method to adjust the magnification (hereinafter called a longitudinal magnification) of the image in a sheet conveyance direction. Namely, the longitudinal magnification is changed by changing the moving speed of the image carrier with respect to scan exposing carried out by a laser diode array or a light emitting diode array in a constant speed in a main scanning direction (a direction perpendicular to the moving direction of the image carrier) and in a sub-scanning direction (the moving direction of the image carrier).

In order to transfer the image formed on the image carrier onto the recording sheet, at a transfer position the recording sheet has to be conveyed in the same speed as that of the image carrier thus in order to change the lateral magnification the recording sheet conveyance speed is changed beside the image carrier moving speed.

Also, in order to match the sheet conveyance speed at a transfer position coincides and the image carrier moving speed, the conveyance speed of the sheet feeding section to feed the sheet to the transfer position is adjusted finely. As a driving section to drive the sheet feeding section, a stepping motor is usually used. By adjusting a frequency of a drive clock pulse to drive the stepping motor, fine adjustment of the conveyance speed of the sheet feeding section is conducted.

In Patent Document 1: Unexamined Japanese Patent Application Publication No. 2009-29003, there is a contraption that a condition not to lose steps of PLL is stored and read so that a rotation speed of a polygon mirror to conduct exposure in the main scanning direction is changed in a minimum amount of time required.

In Patent Document 3: Unexamined Japanese Patent Application Publication No. 2002-2039, besides changing a rotation speed of a photoconductive member, by changing a rotation speed of a register roller in accordance with the change of the rotation speed of the photoconductive member, the longitudinal magnification is changed.

Patent Document 1: Unexamined Japanese Patent Application Publication No. 2009-29003

Patent Document 3: Unexamined Japanese Patent Application Publication No. 2002-2039

As described above, to change the longitudinal magnification, the rotation speed of the polygon mirror and the photoconductive drum is changed and the moving speed of the intermediate transfer belt is changed. However it is known that the above changes are time consuming and decrease productivity. In particular, in a color image forming apparatus utilizing an intermediate transfer method, in order to match the obverse and reverse magnifications, when adjusting the obverse and reverse magnifications, adjusting periods are inserted between every obverse side and reverse side printing which drastically decrease the productivity.

Also, in case the intermediate transfer member and the secondary transfer member are in direct contact or pressed each other having the sheet in between without slippage, if the drive speed of the secondary transfer member is changed, there is a problem that the drive of the intermediate transfer member is interfered and misalignment of transfer and color shift occur.

SUMMARY

The present invention has one aspect to solve the above problems and an object of the present invention is to provide an image forming apparatus which controls longitudinal magnification while inhibiting misalignment of transfer due to a failure caused by a speed difference between the transfer member and the recording sheet, and speed differences among individual transfer members without requiring changing time to change the longitudinal magnification.

To achieve the above object, the image forming apparatus reflecting one aspect of the present invention are as follow.

Item 1. An image forming apparatus, having: an image carrier to carry a toner image; a toner image forming section to form the toner image on the image carrier; an intermediate transfer member to transfer the toner image; a first transfer section to transfer the toner image on the image carrier onto the intermediate transfer member, and a second transfer member to conduct secondary transfer in which the toner image transferred by the first transfer section is transferred onto a sheet and convey the sheet, wherein the control section controls a magnification of the toner image transferred onto the sheet at a secondary transfer position in a sheet conveyance direction to be a target value by changing a rotation speed of the second transfer section while a rotation speed of the intermediate transfer member remains unchanged so as to change a conveyance speed of the sheet.

Item 2. The image forming apparatus of item 1, further having a memory section to store a conversion table in which the rotation speed of the second transfer section and the target value of the magnification of the toner image in the sheet conveyance direction correspond with each other, the control section controls the rotation speed of the second transfer section based on the conversion table.

Item 3. The image forming apparatus of item 1, further having a lubricant applying section to apply a lubricant, wherein the lubricant applying section apply the lubricant onto at least one surface of the intermediate transfer member or the second transfer section.

Item 4. The image forming apparatus of item 1, wherein a plurality of types of the sheet can be conveyed and the control section controls the rotation speed of the second transfer section based on the conversion table corresponding to the type of the sheet to be conveyed.

Item 5. The image forming apparatus of item 1, further comprising:

a registering section located at an upstream side of the second transfer section to adjust sheet conveyance timing when transferring onto the sheet and to transfer the sheet, and a fixing section located at a downstream side to fix the toner image on the sheet on which the toner image is transferred, wherein the control section controls at least a sheet conveyance speed of the register section or a sheet conveyance speed of the fixing section in accordance with the target value of the magnification of the toner image in the sheet conveyance direction.

Item 6. The image forming apparatus of item 1 capable of forming both surfaces of the sheet, wherein the control section controls the rotation speed of the second transfer section when transferring the toner image on the obverse surface of the sheet and the rotation speed of the second transfer section when transferring the toner image on the reverse surface of the sheet respectively.

Item 7. The image forming apparatus of item 1, further comprising an input section to input the target value of the magnification of the toner image transferred onto the sheet in a sheet conveyance direction, wherein the control section acquires a value of the rotation speed of the second transfer section from the conversion table store in the memory section based on the magnification to be inputted to the input section.

BRIEF DESCRIPTION OF THE DRAWINGS

FIGS. 5*a* and 5*b* are conversion tables of longitudinal image magnifications and secondary transfer speeds.

DETAILED DESCRIPTION OF PREFERRED EMBODIMENTS

While the present invention will be described based on the embodiments shown by the figures, the present invention is not limited to the embodiments thereof. Incidentally, the present invention can be applied to the image forming apparatus such as a printer not having an image reading section such as a scanner or an image forming apparatus such as a copying machine having the image reading section such as the scanner.

(Mechanical Configuration of Image Forming Apparatus)

Figure 1:
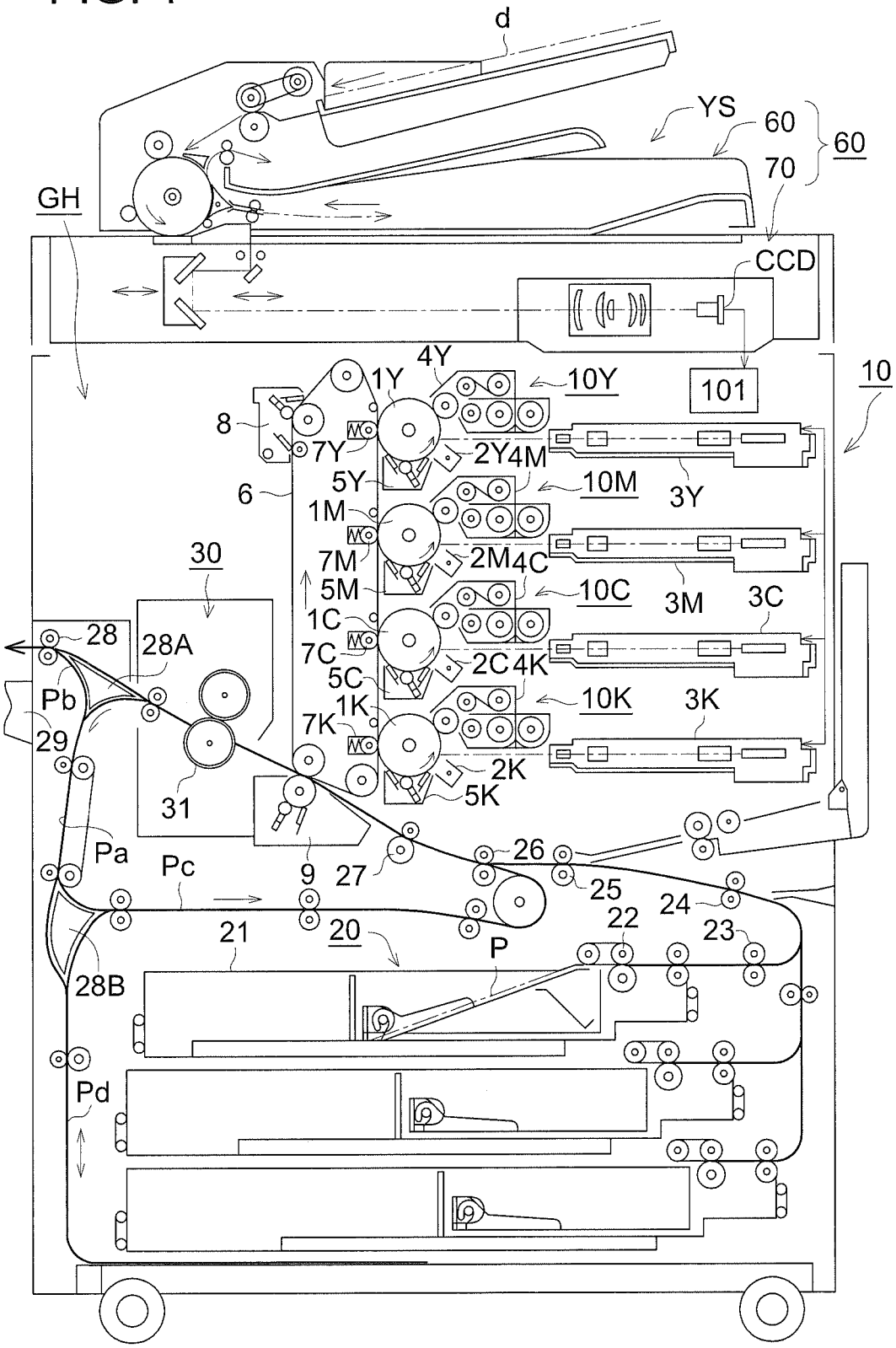
FIG. 1 is an entire configuration of an image forming apparatus.

FIG. 1 is an entire configuration of an image forming apparatus related to the present invention. The image forming apparatus is configured with an image forming apparatus GH and an image reading apparatus YS.

The image forming apparatus GH is so-called a tandem type color image forming apparatus configured with an image forming section 10 having a plurality of sets of toner image fanning sections 10Y, 10M, 10C and 10K as well as an inter mediate transfer belt 6 representing an intermediate transfer member in a shape of a belt, sheet conveyance device 20 and a fixing device 30.

The image forming section 10 forms a toner image on a sheet P conveyed from the sheet feeding section 20 and convey the sheet P on which the toner image is formed to the fixing device 30.

On an upper section of the image forming apparatus GH, the imge reading apparatus YS configured with an automatic document feeding device 60 and a document reading section 70 is installed.

A document d placed on a document table of the automatic document feeding device 60 is conveyed by the conveyance section and the image on one side or images on both sides of the sheet P are subject to scan exposure via an optical system of the document reading section 70 representing a document scan exposure section and read by a line image sensor CCD.

An analogue signal having been subject to photoelectric conversion by the line image sensor CCD is subject to analogue processing, A/D conversion, shading correction and image compression processing in an image processing section 101, thereafter inputted to exposing sections (image writing section) 3Y, 3M, 3C and 3K The toner image forming section 10Y to form a yellow (Y) image is provided with a charging section 2Y, an exposing section 3Y, a developing section 4Y and an image carrier cleaning section 5Y which are disposed at a circumference of the photoconductive drum 1Y representing an image carrier. The toner image forming section 10M to form a magenta (M) image is provided with a charging section 2M, an exposing section 3M, a developing section 4M and an image carrier cleaning section 5M which are disposed at a circumference of the photoconductive drum 1M representing an image carrier. The toner image forming section 10C to form a cyan (C) image is provided with a charging section 2C, an exposing section 3C, a developing section 4C and an image carrier cleaning section 5C which are disposed at a circumference of the photoconductive drum 1C representing an image carrier. The toner image forming section 10K to form a black (K) image is provided with a charging section 2K, an exposing section 3K, a developing section 4K and an image carrier cleaning section 5K which are disposed at a circumference of the photoconductive drum 1K representing an image carrier. The charging section 2Y and the exposing section 3Y, the charging section 2M and the exposing section 3M, the charging section 2C and the exposing section 3C, and the charging section 2K and the exposing section 3K configure latent image forming sections to form electrostatic latent images on the image carrier.

The developing sections 4Y, 4M, 4C and 4K store binary developers which are composed of small particle toners of yellow (Y), magenta (M), cyan (C) and black (K), and a carrier.

The images of respective colors formed by the toner image forming sections 10Y, 4M, 4C and 4K are sequentially transferred (primary transfer) onto the intermediate transfer belt 6 in rotation by the primary transfer sections 7Y, 7M, 7C and 7K so that a combined color image is formed.

While the toner image forming sections for yellow, magenta, cyan and black colors and the components thereof are distinguished by suffixes Y, M, C, and K, the suffixes are omitted except that distinguishing is necessary.

The primary transfer section 7 is configured with an unillustrated primary transfer roller and a spring to bias the primary transfer roller onto the intermediate transfer belt 6.

The sheet P stored in a sheet feeding cassette 21 of the sheet feeding apparatus 20 is fed by the sheet feeding section 22 and conveyed by the sheet feeding rollers 23, 24, 25 and 26. Then the sheet P stops once so as to register a frond end of the sheet P and the front end of the image, thereafter passes through the register roller 27 which adjusts timing and the sheet P is conveyed to the secondary transfer roller 9*a* where the color image is secondarily transferred onto the sheet P. The register roller 27 serves a function of a register section.

The secondary transfer roller 9*a* is a conductive transfer roller to which a transfer voltage is applied by an unillustrated power source.

The secondary transfer roller 9*a* configures the secondary transfer section 9 to transfer the toner image from the intermediate transfer belt 6 onto the sheet P.

The sheet P on which the color image is transferred is nipped by the fixing device 30 and by applying heat and pressure the color toner image on the sheet P is fixed onto the sheet P. Then nipped by the sheet ejection rollers 28, the sheet P is placed on a sheet ejection tray 29 outside the apparatus.

On the other hand, after transferring the color image onto the sheet P via the secondary transfer section 9, the intermediate transfer belt 6 from which the sheet P is separated by self stripping is clean by the intermediate transfer member cleaning device 8 to remove residual toner.

In case the sheet P having been subject to fixing processing is reversely ejected, the sheet P passes through a conveyance path located on the right side of a bifurcation plate 28A in the figure disposed between the fixing device 30 and the sheet ejection roller 28, then after being conveyed to a first conveyance path Pa at a lower portion, the sheet P is reversely conveyed and passes through a second conveyance path Pb on the left side of the bifurcation plate 28A in the figure so as to be ejected outside the apparatus via the ejection roller 28.

In case of copying on both sides of the sheet P, after fixing the image formed on the first surface (obverse surface) of the sheet P, the sheet P enters into the first conveyance path Pa then further enters into a fourth conveyance path Pd under the bifurcation plate 28B, thereafter the sheet P is reversely conveyed so as to pass through the conveyance path on the right side of the bifurcation plate 28B and conveyed to a third conveyance path Pc. Then the sheet P is diverted upward to be conveyed by the sheet feeding roller 26. The toner image forming sections 10Y, 10M, 10C and 10K form respective colors of the images on the second surface (reverse surface) of the sheet P and the sheet P is subject to heat fixing processing via the fixing device 30 then ejected outside the apparatus via sheet ejection roller 28.

Figure 2:
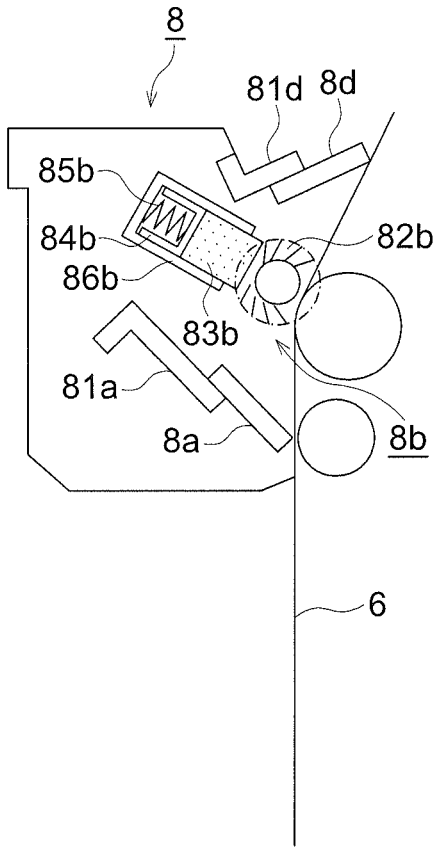
FIG. 2 is a cross-sectional view of an intermediate transfer member cleaning section 8.

FIG. 2 is a cross-sectional view of the intermediate transfer member cleaning device 8.

A cleaning blade 8*a* configured with an elastic member in a plate shape is in contact with the intermediate transfer belt 6 at an edge towards an opposite direction (counter method) to a rotation direction of the intermediate transfer belt 6. As the cleaning blade 8*a*, for example, a urethane rubber attached to a support metal plate 81*a* is used.

At a downstream side of the cleaning blade 8*a* in the rotation direction of the intermediate transfer belt 6 and under the intermediate transfer belt 6, there is disposed a lubricant applying device 8*b* to apply a lubricant to the intermediate transfer member. The lubricant application device 8*b* is configured with a brush roller 82*b*, a solid form lubricant 83*b*, a support guide 86*b* to retain the lubricant 83*b*, a push up table 84*b* which slides in the support guide 86*b* and a pressing spring 85*b* to make the lubricant 83*b* in contact with the brush roller 82*b* via the push up table 84*b* under a predetermined pressure. As materials of the lubricant 83*b*, for example, a zinc stearate (ZnSt) having a hardness equivalent to pencil hardness of HB is used. By rotating the brush roller 82*b* the lubricant 83*b* is scraped off and adheres on ends of bristles of the brush and by contacting the brush with the surface of the intermediate transfer belt 6, fine powder of the lubricant 83*b* scraped off is applied to the intermediate transfer belt 6.

The brash roller 82*b* is rotated and driven by an unillustrated motor whose rotation speed is variable. By increasing the rotation speed, an amount of the fine power of the lubricant increases and by decreasing the rotation speed, the amount of the fine power of the lubricant decreases.

A leveling section 8*d* in contact with the surface of the intermediate transfer belt 6 is disposed at a further downstream side of the lubricant application device 8*b*. The leveling section 8*d* configured with a blade formed by an elastic member in a plate shape is in contact with the intermediate transfer belt 6 at an edge towards the same direction as the rotation direction of the intermediate transfer belt 6. By disposing the leveling section 8*d* there is an effect that the lubricant applied by the lubricant application device 8*b* is pressed onto the intermediate transfer belt 6 and it is possible that the thickness of the lubricant is controlled and adhesion with respect to the surface thereof is enhanced.

Figure 3:
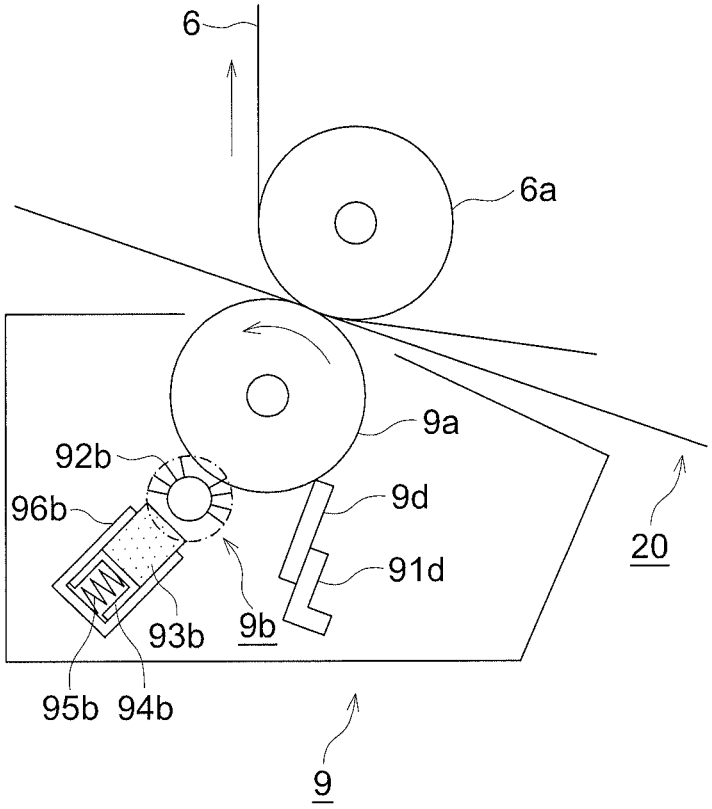
FIG. 3 is a cross-sectional view of a periphery of second transfer section.

FIG. 3 is a cross-sectional view of a periphery of second transfer section.

The lubricant application device 9*b* to apply the lubricant to the second transfer member is configured with a brush roller 92 *b*, a solid form lubricant 93*b*, a support guide 96*b* to retain the lubricant 93*b*, a push up table 94*b* which slides in the support guide 96*b* and a pressing spring 95*b* to make the lubricant 93*b* in contact with the brush roller 92*b* via the push up table 94*b* under a predetermined pressure. As materials of the lubricant 93*b*, for example, a zinc stearate (ZnSt) having a hardness equivalent to pencil hardness of HB is used. By rotating the brush roller 92*b* the lubricant 93*b* is scraped off and adheres on ends of bristles and by contacting the brush with the surface of the second transfer roller 9*a*, the fine powder of the lubricant 93*b* scraped off is applied to the second transfer roller 9*a*.

The brash roller 92*b* is rotated and driven by an unillustrated motor where rotation speed is variable. By increasing the rotation speed, an amount of the fine power of the lubricant to be applied to the second transfer roller 9*a* increases and by decreasing the rotation speed, the amount thereof decreases.

A leveling section 9*d* in contact with the surface of the second transfer roller 9*a* is disposed at a further downstream side of the lubricant application device 9*b*. The leveling section 9*d* configured with a blade formed by an elastic member in a plate shape is in contact with the second transfer roller 9*a* at an edge towards the same direction as the rotation direction of the second transfer roller 9*a*. By disposing the leveling section 9*d* there is an effect that the lubricant applied by the lubricant application device 9*b* is pressed onto the second transfer roller 9*a* and it is possible that the thickness of the lubricant is controlled and adhesion with respect to the surface thereof is enhanced.

The intermediate transfer belt 6 supported by the intermediate transfer roller 6*a* and the second transfer roller 9*a* are in contact with each other. When the sheet P is nipped and conveyed to the fixing device 30, by the effect of the lubricant from the lubricant application device 9*b* the sheet P is conveyed while the sheet P is slipping with respect to the second transfer roller 9*a*. In the same manner, by the effect of the lubricant from the aforesaid lubricant application device 8*b*, the sheet P I conveyed while the sheet P is slipping with respect to the intermediate transfer belt 6.

The lubricant application device 8*b* and the lubricant application device 9*b* serve a function of the lubricant application section of the present invention.

Incidentally, in the description of the image forming apparatus GH, while color image forming has been described, the monochrome image forming is included in the present invention.

(Electrical Configuration of Image Forming Apparatus)

Figure 4:
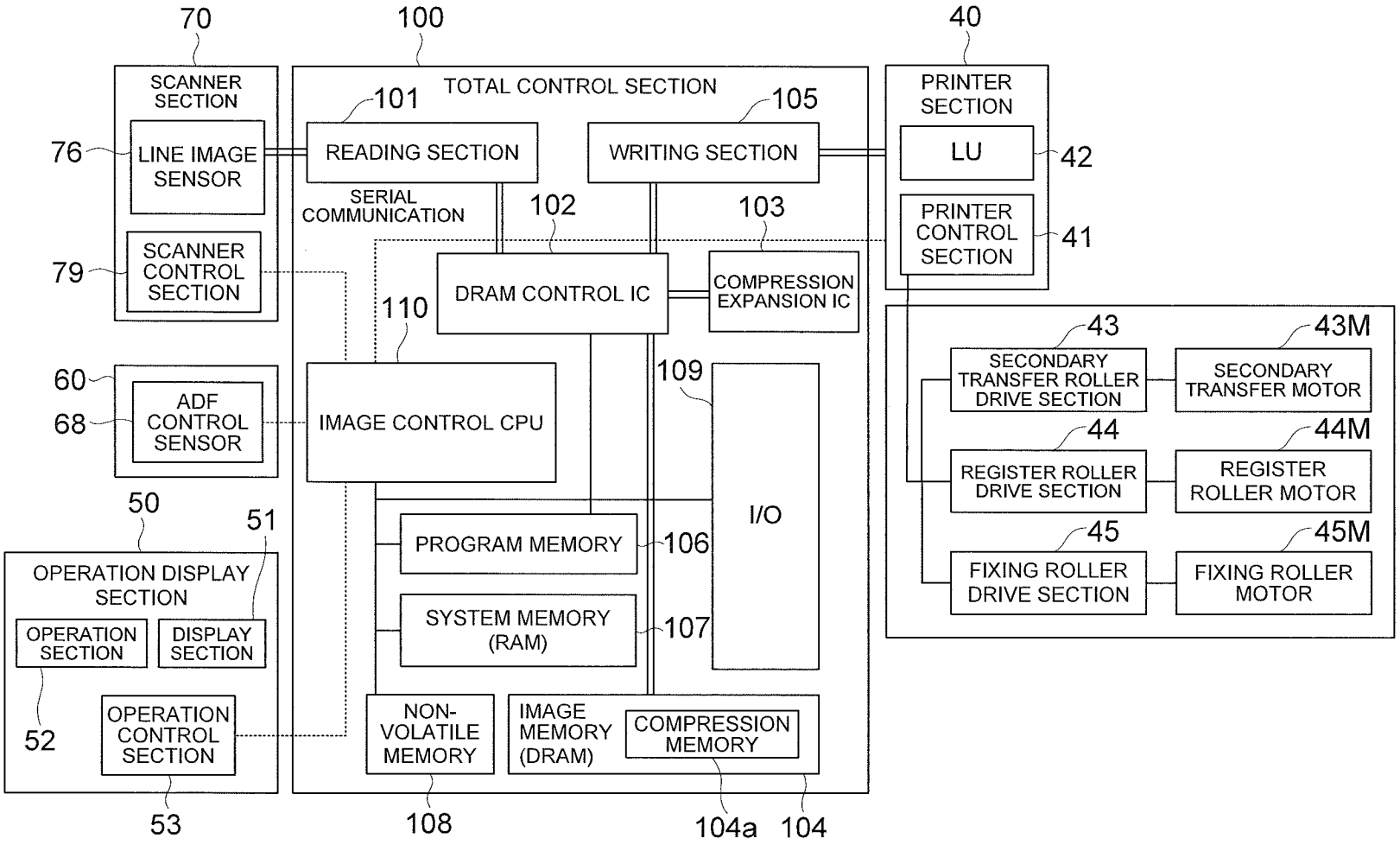
FIG. 4 is a block diagram of a circuitry showing electrical configuration of the image forming apparatus.

FIG. 4 is a block diagram showing an electrical configuration of an image forming apparatus. The automatic document feeding device 60 is provided with an ADF control section 68 to control the unillustrated drive section. The document reading section (scanner section) 70 is provided with a line image sensor 76 and a scanner control section 79. The scanner control section 79 conducts control of on and off of a light source and control of moving a scan exposing section An operation control section 50 is provided with a display section 51 configured with a liquid crystal display (LCD), an operation section 52 configured with touch switches located on a screen thereof and switches and an operation control section 53 to control operation of the above sections.

The printer section 40 is provided with a laser unit 42 and a printer control section 41. Also, the printer control section 41 is provided with functions to control operations of a charging device 2, a primary transfer section 7, voltage application to a separation device, a developing device 4, a second transfer section 9, an intermediate transfer member cleaning device 8, a fixing device 30 and a sheet feeding conveying device 20. The printer control section 41 serves a function of control section of the present invention.

Also, the printer control section 41 is provided with a second transfer motor 43M to rotate the second transfer roller 9*a*, a second transfer roller drive section 43 which controls the second transfer motor 43 M to rotate at a predetermined rotation speed, a register roller motor 44M to rotate a register roller 27, a register roller drive section 44 to start rotation of the register roller motor 44M in a way that timing of front end of the sheet coincides with timing of the front end of the image coincide, and perform conveyance control of the sheet P at a predetermined speed a fixing roller motor 45 M disposed in the fixing device 30 to rotate the fixing roller 31, and a fixing roller drive section 45 which controls the fixing roller motor 45 M so as to rotate at a predetermined speed.

The ADF control section 68, the scanner control section 79, the operation control section 53 and the printer control section 41 are configured with respective circuitries having CPUs, ROMs and RAMs as main components. Various kinds of controls are executed in accordance with programs stored in the ROMs.

The total control section 100 serves a function to conduct overall control of operation of the image forming apparatus GH. The total control section 100 is provided with a reading process section 101, a DRAM control IC 102, a compression/extension IC 103, an image memory 104, a writing process section 105, an image control CPU 110, a program memory 106, a system memory 107, a nonvolatile memory 108 representing a memory section of the present embodiment and an I/O port 109.

The reading process section 101 servers functions of enlargement processing, mirror image processing binarization process by error diffusion with respect to the image data outputted from the document reading section (scanner section) 70. The compression/extension IC 103 serves a function in compressing a binarized image data or extending a compressed image data. The image memory 104 serves a function as a page memory capable of storing non-compressed image data by pages and a function as a compression memory 104*a* to accumulate compressed image data.

The writing process section 105 serves a function to transmit extended image data read out from the image memory 104 to a laser unit 42 configured with exposing sections 3Y, 3M, 3C and 3K with timing corresponding to operation of the printer section 40. DRAM control IC 102 conducts timing control of reading/writing and refreshing of the image memory 104 configured with a dynamic RAM, compressing and storing the image data in the image memory 104, and reading the compressed data from the image memory 104 and extending it.

The image control CPU 110 is a CPU to control entire operation of the image forming apparatus GH and serves functions to control flow of the image data and to control entry of a programmed job and execution of the job. The program memory 106 is a memory in which a program to be executed by the image control CPU 110 is stored and a system memory 107 is a work memory to temporally store various kinds of data while the program is being executed. The image control CPU 110 controls entire image forming apparatus GH while conducting serial communication with the printer control section 41 in accordance with the program stored in the program memory 106 with reference to data in the system memory 107.

Nonvolatile memory 108 is a memory to store user data and system data to be store even after turning off the power. To the I/O port 109 various kinds of sensors such as sheet size detection sections to detect sheet sizes set in respective sheet feeding trays and LED elements are connected.

Before starting image forming, in a setting predetermined mode, a key operator or a user sets sheet size and sheet type of the sheets to be stacked in respective sheet feeding trays via the operation display section 50 in accordance with a sheet setting screen of the sheet tray displayed on the display section 51 by the image control CPU 110 the above conditions are stored in the nonvolatile memory 108 by the image control CPU 110.

Incidentally, while the control of the control section of the present embodiment will be described as a function of the printer control section 41, it can be functions of the total control section 100 and the printer control section 41 or a function of the total control section 100. Also, in the same manner as the total control section 100, the printer control section 41 is provided with an unillustrated control CPU, a program memory, a system memory and a nonvolatile memory.

From here, there will be specifically described control of magnification of the image to be transfer at the secondary transfer position in the conveyance direction by changing the rotation speed of the second transfer roller 9*a* representing the second transfer section of the present embodiment.

The register roller 27 is to match a front end of the sheet with a front end of the image by synchronizing timing by stopping the sheet once. The sheet P conveyed from the register roller 27 is nipped by an intermediate transfer belt 6, which is supported rotatably by intermediate transfer rollers 6*a*, and the secondary transfer roller 9*a* to be conveyed simultaneously when a toner image carried by the intermediate transfer belt 6 is secondarily transferred onto the sheet P.

When the sheet P is conveyed in the secondary transfer section 9, the sheet P slips with respect to the intermediate transfer belt 6 since the lubricant is applied on the intermediate transfer belt 6 by the lubricant application device 8*b* and the sheet P slips with respect to the secondary transfer roller 9*a* since the lubricant is applied on the surface of the secondary transfer roller 9*a* by the lubricant application device 9*b*.

By increasing the rotation speed of the secondary roller 9*a* while keeping the speed of the intermediate transfer belt 6 constant, the sheet P is conveyed faster than the rotation speed of the intermediate transfer belt 6, as a result the toner image transferred onto the sheet P is enlarged in the conveyance direction. By decreasing the rotation speed of the secondary transfer roller 9*a* compared to the speed of the intermediate transfer belt 6, the sheet P is conveyed slower than the rotation speed of the intermediate transfer belt 6, as a result the toner image transferred onto the sheet P is contracted in the conveyance direction.

An amount of enlarging and contracting of the image to be transferred onto the sheet P created by the speed difference between the intermediate transfer belt 6 and the secondary transfer roller 9*a* varies with a plurality of types of the sheet P capable of being conveyed, for example, sheet thickness. FIGS. 5*a* and 5*b* show examples of a conversion tables in which the target values of longitudinal magnification of the image correspond to the secondary transfer speeds.

FIG. 5*a* is a conversion table in case of a thick sheet having the basis weight of 300 g/m$^2$ and the FIG. 5*b* is a conversion table in case of a thin sheet having the basis weight of 64 g/cm$^2$.

Also, in order to match the image sizes of the image on the obverse side which has been passed through the fixing device and the size of the image of the reverse side, the rotation speed of the secondary transfer roller 9*a* when transferring on the obverse side and the rotation speed of the secondary transfer roller 9*a* when transferring on the reverse side are controlled respectively.

By according the rotation speed of the register roller 27 and the fixing roller 31 with the sheet conveyance speed, the conveyance of the sheet P can be stabilized.

Figure 6:
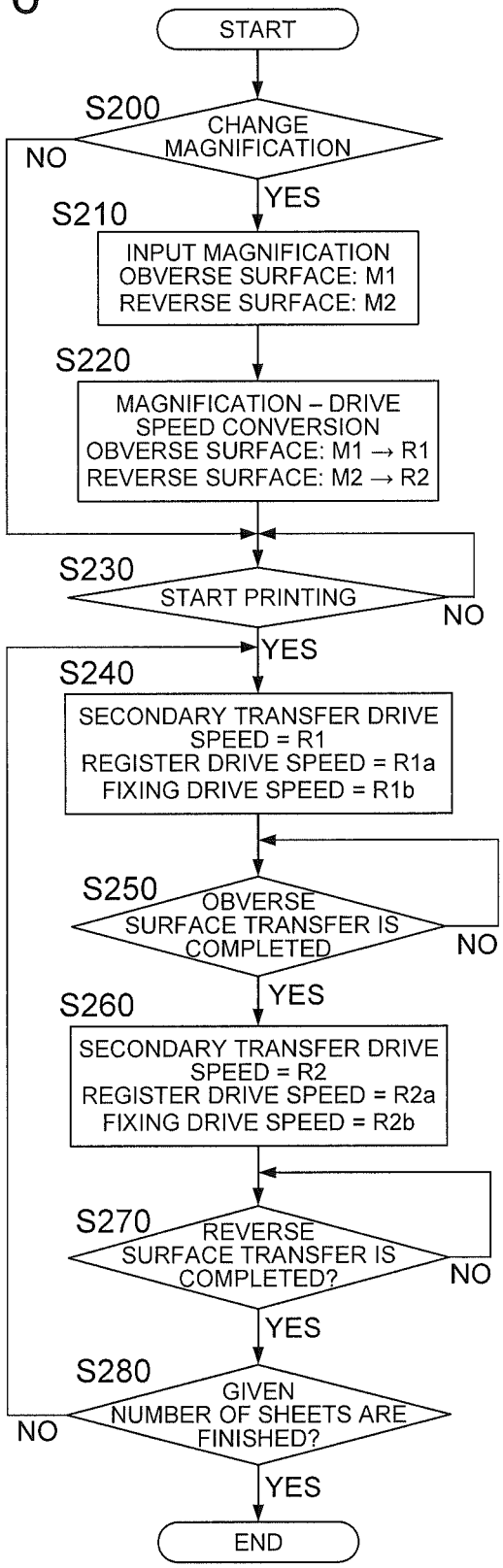
FIG. 6 is a flow chart to control a magnification of an image in a conveyance direction.

FIG. 6 shows a flow chart to control the magnification of the image in the conveyance direction.

Step 200 judges whether or not the target value of the magnification of the image in the conveyance direction exists. In case the judgment result is "No", the operation procedure proceeds to Step 230 and in case it is "Yes" the operation procedure proceeds to Step 210.

In Step 210, the target value of the magnification image is inputted by inputting values via the operation section 52 representing an input section of the present embodiment by an operator or by a maintenance and service staff, or by transmitting values from external devices such as a PC and a network via I/O port 109. Here, a magnification M1 of the obverse side and a magnification M2 of the reverse side can be set.

The conversion table shown by FIGS. 5*a* and 5*b* stored in the nonvolatile memory 108. In accordance with the inputted magnification M1 of the obverse side and the magnification M2 of the reverse side, a rotation speed coefficient R1 to determine the secondary transfer roller at conveyance of the obverse side and a rotation speed coefficient R2 of the secondary transfer roller at conveyance of the reverse side are set from the conversion table in the nonvolatile memory 108 (Step 220).

For example, in case the sheet subject to secondary transfer is the thick sheet having the basis weight of 300 g/m$^2$, the magnification of the obverse side is increased by 0.2%, thus +5% of the rotation speed coefficient R1 of the secondary transfer roller 9*a* obtained from the conversion table in FIG. 5*a* is set, and in case the magnification of the reverse side is not changed, ±0% of the rotation speed coefficient R2 of the secondary transfer roller 9*a* obtained from the conversion table in FIG. 5*a* is set.

R1 and R2 having been set are stored in the nonvolatile memory 108 so that the same rotation speed coefficient of the secondary transfer roller is applied whenever the thick sheet of 300 g/m$^2$ is selected.

In Step 230, the operation procedure waits until a printing command is received. In case printing command is "Yes" the operation procedure proceeds to a next step.

In Step 240, printing on the obverse side starts. The printer control section 41 drives the secondary transfer motor 43M by controlling the secondary transfer roller drive section 43 in accordance with the rotation speed coefficient R1 of the secondary transfer roller. At the same time, the printer control section 41 drives a register roller motor 44M and a fixing roller motor 45M by setting a drive speed coefficient R1*a* of the register roller and a drive speed coefficient R2*b* of the fixing roller, wherein the longitudinal image magnification of the sheet corresponding to the rotation speed coefficient R1 of the secondary roller, namely the target value of the magnification of the image in the conveyance direction of the secondary transfer is the speed coefficient.

As the aforesaid example, in case of the thick sheet having the basis weight of 300 g/m$^2$, the rotation speed coefficient R1 of the secondary transfer roller 9*a* is +5% and a target value of the longitudinal image magnification from the conversion table in FIG. 5*a* is applied, and the drive speed coefficient Rla of the register roller 27 is set to be +0.2% and the drive speed coefficient Rib of the fixing roller 31 is set to be +0.2%. Whereby, in case the secondary transfer is carried out while the sheet is being pressed and conveyed by the register roller and while the sheet is being pressed and conveyed by the fixing roller, the conveyance speed of the sheet can be stabilized.

In case the secondary transfer onto the obverse side is completed in Step 250 (the result of judgment is "Yes"), the operation procedure proceeds to a next step.

In Step 260, printing of reverse side starts, the secondary transfer roller 9*a* is driven in accordance with the rotation speed coefficient R2 of the secondary transfer roller 9*a*, and the drive speed coefficient R2*a* of the register roller 27 corresponding to the rotation speed coefficient R2 of the secondary transfer roller 9*a* and the drive speed coefficient R2*b* of the fixing roller 31 are set, then the register roller motor 44M and the fixing roller motor 45M are driven.

As the aforesaid example, in case the magnification of the reverse side is not changed, with reference to the conversion table in FIG. 5*a*, the rotation speed coefficient R2 of the secondary transfer roller 9*a* is set to be ±0% so as to conduct secondary transfer.

In case the secondary transfer for the reverse side is completed in Step 280, (judgment result is "Yes"), the processing procedure proceeds to the next step.

The Step 240 to the Step 280 are repeated until printing of a designated number of the sheets is completed, wherein the designated number is set by the operator via the operation section 52 or by the PC or the network via the I/O port 109, and operation is terminated when the printing of the designated number of the sheets is completed.

As above, since the lubricant is applied by the lubricant application device Sb on the intermediate transfer belt 6, the intermediate transfer belt 6 and the sheet P slips each other and a conveyance force is created. Also, since the lubricant is applied by the lubricant application device 9*b* on the surface of the secondary transfer roller 9*a*, the secondary transfer roller 9*a* and the sheet P slip each other and a conveyance force is created. Whereby, in the secondary transfer section 9 the image can be enlarged or contracted when the image is transferred from the intermediate transfer belt.

Incidentally, the in case of printing only on the obverse surface the Steps 260 and 270 in the flow chart are omitted.

Also, in an apparatus where the image size differs in the conveyance direction on the sheet after transferring due to a difference of printing rate of the image transferred onto the sheet, the image size on the sheet can be adjusted by performing the same control as above.

As above the intermediate transfer belt 6 supported by the intermediate transfer roller 6*a* is in contact with the secondary transfer roller 9*a*. When the sheet P is nipped and conveyed to the fixing device 30, by the effect of the lubricant applied by the lubricant application device 9*b*, the sheet P is conveyed while slipping with respect to the secondary transfer roller 9*a*. Whereby, by changing the rotation speed of the secondary transfer roller 9*a*, the magnification of the image to be transferred onto the sheet in the conveyance direction can be changed.

Also, the present invention includes a secondary transfer section using a transfer belt supported and suspended by a plurality of the supporting rollers which is substitution of the secondary transfer roller 9*a*.

By changing the rotation speed of the secondary transfer section, the longitudinal magnification can be changed while prohibiting misalignment of transfer due to failure of drive caused by speed differences between the transfer member and sheet, and among each of transfer members without requiring changing time to change the longitudinal magnification which decreases productivity.

What is claimed is:

1. An image forming apparatus, comprising:

an image carrier to carry a toner image;

a toner image forming section to form the toner image on the image carrier:

an intermediate transfer member to transfer the toner image:

a first transfer section to transfer the toner image on the image carrier onto the intermediate transfer member, and a second transfer member to conduct secondary transfer in which the toner image transferred by the first transfer section is transferred onto a sheet and convey the sheet, a control section;

a registering section located at an upstream side of the second transfer section to adjust sheet conveyance timing when transferring onto the sheet and to transfer the sheet, and a fixing section located at a downstream side to fix the toner image on the sheet on which the toner image is transferred, wherein the control section controls a magnification of the toner image transferred onto the sheet at a secondary transfer position in a sheet conveyance direction to be a target value by changing a rotation speed of the second transfer section while a rotation speed of the intermediate transfer member remains unchanged so as to change a conveyance speed of the sheet while controlling at least a sheet conveyance speed of the register section or a sheet conveyance speed of the fixing section in accordance with the target value of the magnification of the toner image in the sheet conveyance direction.

2. The image forming apparatus of claim 1, further comprising a memory section to store a conversion table in which the rotation speed of the second transfer section and the target value of the magnification of the toner image in the sheet conveyance direction correspond with each other, the control section controls the rotation speed of the second transfer section based on the conversion table.

3. The image forming apparatus of claim 2, wherein a plurality of types of the sheet can be conveyed and the control section controls the rotation speed of the second transfer section based on the conversion table corresponding to the type of the sheet to be conveyed.

4. The image forming apparatus of claim 2, further comprising an input section to input the target value of the magnification of the toner image transferred onto the sheet in a sheet conveyance direction, wherein the control section acquires a value of the rotation speed of the second transfer section from the conversion table store in the memory section based on the magnification to be inputted to the input section.

5. The image forming apparatus of claim 1, further comprising a lubricant applying section to apply a lubricant, wherein the lubricant applying section apply the lubricant onto at least one surface of the intermediate transfer member or the second transfer section.

6. The image forming apparatus of claim 1 capable of forming both surfaces of the sheet, wherein the control section controls the rotation speed of the second transfer section when transferring the toner image on the obverse surface of the sheet and the rotation speed of the second transfer section when transferring the toner image on the reverse surface of the sheet respectively.

* * * * *